United States Patent [19]

Kodama

[11] Patent Number: 5,054,762

[45] Date of Patent: Oct. 8, 1991

[54] REMOVABLE UNIT FOR AN IMAGE FORMING APPARATUS ADAPTED TO RECEIVE SHEET CASSETTES AND GUIDE PAPER SHEETS THEREFROM

[75] Inventor: Yutaka Kodama, Tokyo, Japan

[73] Assignee: Ricoh Company, Ltd., Tokyo, Japan

[21] Appl. No.: 412,931

[22] Filed: Sep. 26, 1989

[30] Foreign Application Priority Data

Sep. 28, 1988 [JP] Japan ..... 63-240674

[51] Int. Cl.[5] ..... B65H 1/00

[52] U.S. Cl. ..... 271/162; 271/127; 271/145

[58] Field of Search ..... 271/117, 127, 162, 164, 271/241, 145

[56] References Cited

U.S. PATENT DOCUMENTS

| | | | |
|---|---|---|---|
| 4,565,360 | 1/1986 | Runzi | 271/127 X |
| 4,900,005 | 2/1990 | Blyth et al. | 271/117 X |

FOREIGN PATENT DOCUMENTS

| | | | |
|---|---|---|---|
| 203016 | 11/1984 | Japan | 271/162 |
| 36234 | 2/1985 | Japan | 271/162 |
| 82535 | 5/1985 | Japan | 271/145 |
| 167136 | 7/1987 | Japan | 271/162 |
| 235134 | 10/1987 | Japan | 271/164 |
| 277135 | 11/1988 | Japan | 271/127 |
| 13526 | 1/1990 | Japan | 271/162 |

*Primary Examiner*—Robert P. Olszewski
*Assistant Examiner*—Boris Milef
*Attorney, Agent, or Firm*—Oblon, Spivak, McClelland, Maier & Neustadt

[57] ABSTRACT

A sheet feeder for an image forming apparatus implemented as a unit which is removable from a body of the apparatus and can be positioned relative to the apparatus body with accuracy. Side plates which form a part of a housing each has a bent portion through which a hole is formed, and a projection provided with a notch. The holes of the side plates are individually mated with positioning pins which are studded on two posts of the image forming apparatus, while the notches are individually mated with positioning pins which are affixed to a bottom panel of the apparatus.

4 Claims, 6 Drawing Sheets

REMOVABLE UNIT FOR AN IMAGE FORMING APPARATUS ADAPTED TO RECEIVE SHEET CASSETTES AND GUIDE PAPER SHEETS THEREFROM

BACKGROUND OF THE INVENTION

The present invention relates to a sheet feeder for an image forming apparatus and, more particularly, to a sheet feeder constructed into a unit which is removable from a body of an image forming apparatus and can be positioned relative to the latter with improved accuracy.

With a prior art laser printer, facsimile machine, copier or similar image forming apparatus adopting an electrophotographic procedure, it has been customary to mount a sheet feeder directly and rigidly to the side panels of the apparatus body. A problem with such a scheme is that various components and structural elements of the sheet feeder are different from each other in assembling sequence and fastening direction, resulting in uneasy and inefficient assembling work. When any of the components of the sheet feeder wears out or is damaged, it cannot be replaced or repaired unless other various components which are fastened to the apparatus body are unfastened also. Thus, the prior art sheet feeder arrangement involves time-consuming work in assembly and disassembly as well as in the replacement of components, resulting in inefficient maintenance.

SUMMARY OF THE INVENTION

It is therefore an object of the present invention to provide a sheet feeder for an image forming apparatus implemented as a unit which is removable from a body of the apparatus and can be positioned relative to the apparatus body with improved accuracy.

It is another object of the present invention to provide a generally improved sheet feeder for an image forming apparatus.

A sheet feeder for an image forming apparatus for feeding paper sheets from a sheet cassette which is removably loaded in the sheet feeder of the present invention comprises cassette supporting members comprising a guide member for guiding the sheet cassette when the sheet cassette is mounted and a pusher member for raising a bottom plate of the sheet cassette, a sheet guiding member for guiding the paper sheet fed from the sheet cassette, a pair of side plate members each having a bent portion to be fastened to a post of the image forming apparatus and a projection to be engaged with a bottom panel of the image forming apparatus, a hole formed through the bent portion for mating with a first positioning pin which is studded on the post, and a notch formed in the projection for mating with a second positioning pin which is affixed to the bottom panel.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
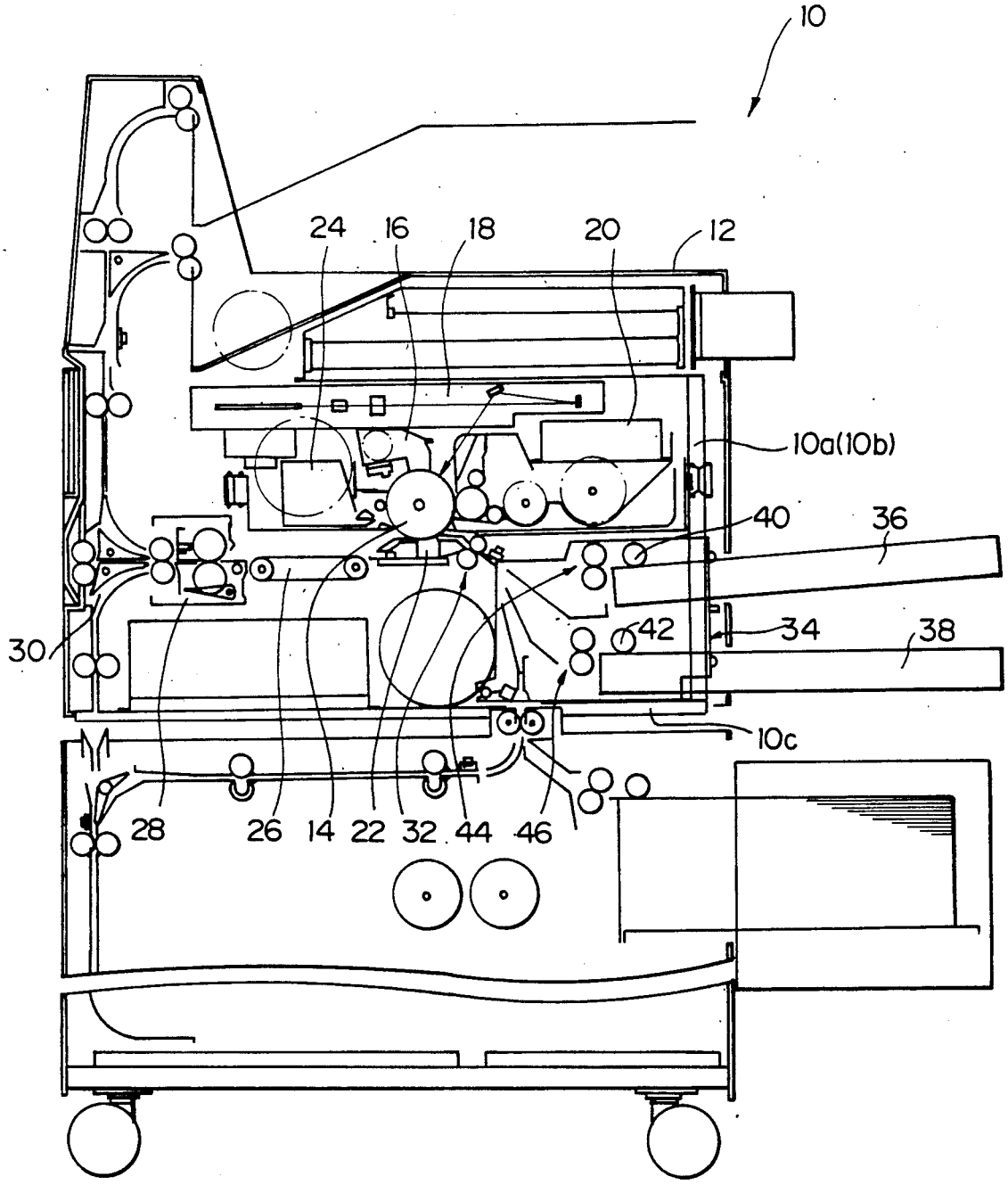
FIG. 1 is a section of a laser printer to which the present invention is applicable.

Referring to FIG. 1 of the drawings, a laser printer belonging to a family of image forming apparatuses to which the present invention is applicable is shown. The laser printer, generally 10, has a housing 12 which accommodates an image carrier in the form of a photoconductive drum 14 therein. Arranged around the drum 14 are a main charger 16, optics 18, a developing device 20, an image transferring and sheet separating device 22, a cleaning device 24, a transport belt 26 for transporting a paper sheet undergone image transfer, a fixing device 28, a path switching device, and a register roller pair 32. Two posts 10*a* and 10*b* extend upright from a bottom panel 10*c* of the printer 10. A sheet feeder 34 embodying the present invention is also accommodated in the printer housing 12 in close proximity to the register roller pair 32. Two sheet cassettes 36 and 38 are removably loaded in the sheet feeder 34 at one side of the printer 10. The sheet feeder 34 has pull-out rollers 40 and 42 and feed roller pairs 44 and 46 for feeding paper sheets from desired one of the sheet cassettes 36 and 38. The sheet feeder 34 is implemented as a unit which is removable from the printer 10, as described in detail later.

Figure 2:
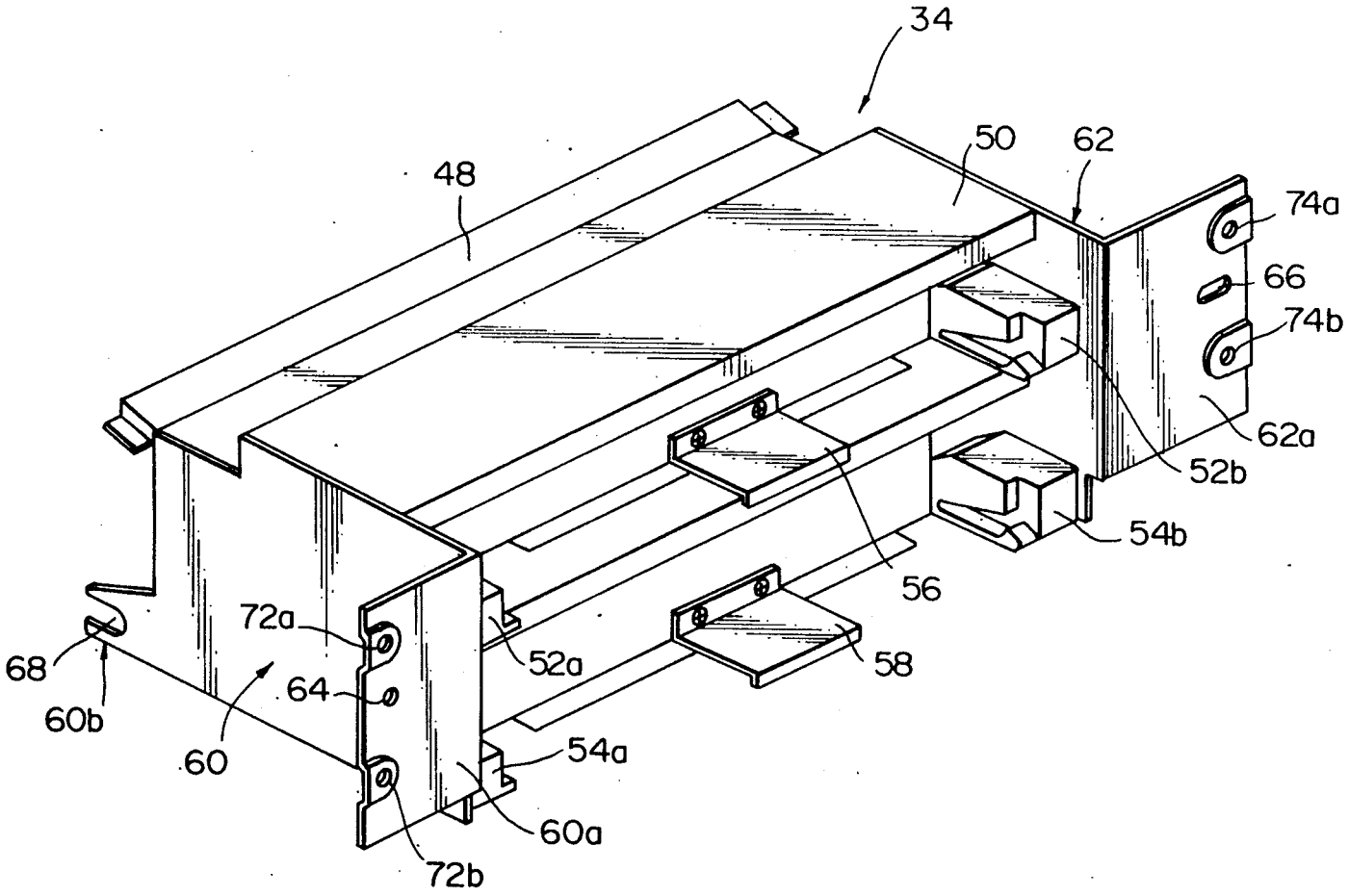
FIG. 2 is a perspective view of a sheet feeder embodying the present invention and which is installed in the laser printer of FIG. 1.

FIG. 2 shows the sheet feeder 34 embodying the present invention in a perspective view. As shown, the sheet feeder 34 is made up of a guide plate 48, a top cover 50, cassette guides 52*a* and 52*b* and 54*a* and 54*b* for guiding respectively the sheet cassettes 36 and 38 into and out of the sheet feeder 34, pushers in the form of plates 56 and 58 respectively positioned substantially at the intermediate between the cassettes guides 52*a* and 52*b* and 54*a* and 54*b* for raising the bottom plates of the cassettes 36 and 38, and a pair of side plates 60 and 62 having respectively a bent portion 60*a* and a projection 60*b* and a bent portion 62*a* and a projection 62*b* (only 62*a* is visible). The bent portions 60*a* and 62*a* are respectively provided with holes 64 and 66 for receiving positioning pins which will be described. The projections 60*b* and 62*b* are respectively provided with notches 68 and 70 (only 68 is visible) for receiving positioning pins which will also be described. Further, the bent portions 60*a* and 62*a* are respectively provided with holes 72*a* and 72*b* and 74*a* and 74*b* through which screws which will be described are passed. As shown, the holes 72*a*, 72*b*, 74*a* and 74*b* are formed through embossed parts of the bent portions 60*a* and 62*a*. The surfaces of the bent portions 60*a* and 60*b* are so shaped as to individually join one surface of the posts 10*a* and 10*b* of the printer 10, FIG. 1. The positional relationship between the bent portions 60*a* and 60*b* and the posts 10*a* and 20*b* are shown in detail in FIG. 3. In the sheet feeder 34, the pull-out roller 40 and transport roller pair 44 are located at the same level as the cassette guide 56, while the pull-out roller 42 and transport roller pair 46 are positioned at the same level as the cassette guide 58. This allows the sheet cassettes 36 and 38 to be accurately positioned relative to their associated pull-out rollers 40 and 42 and transport rollers 44 and 46.

Figure 3:
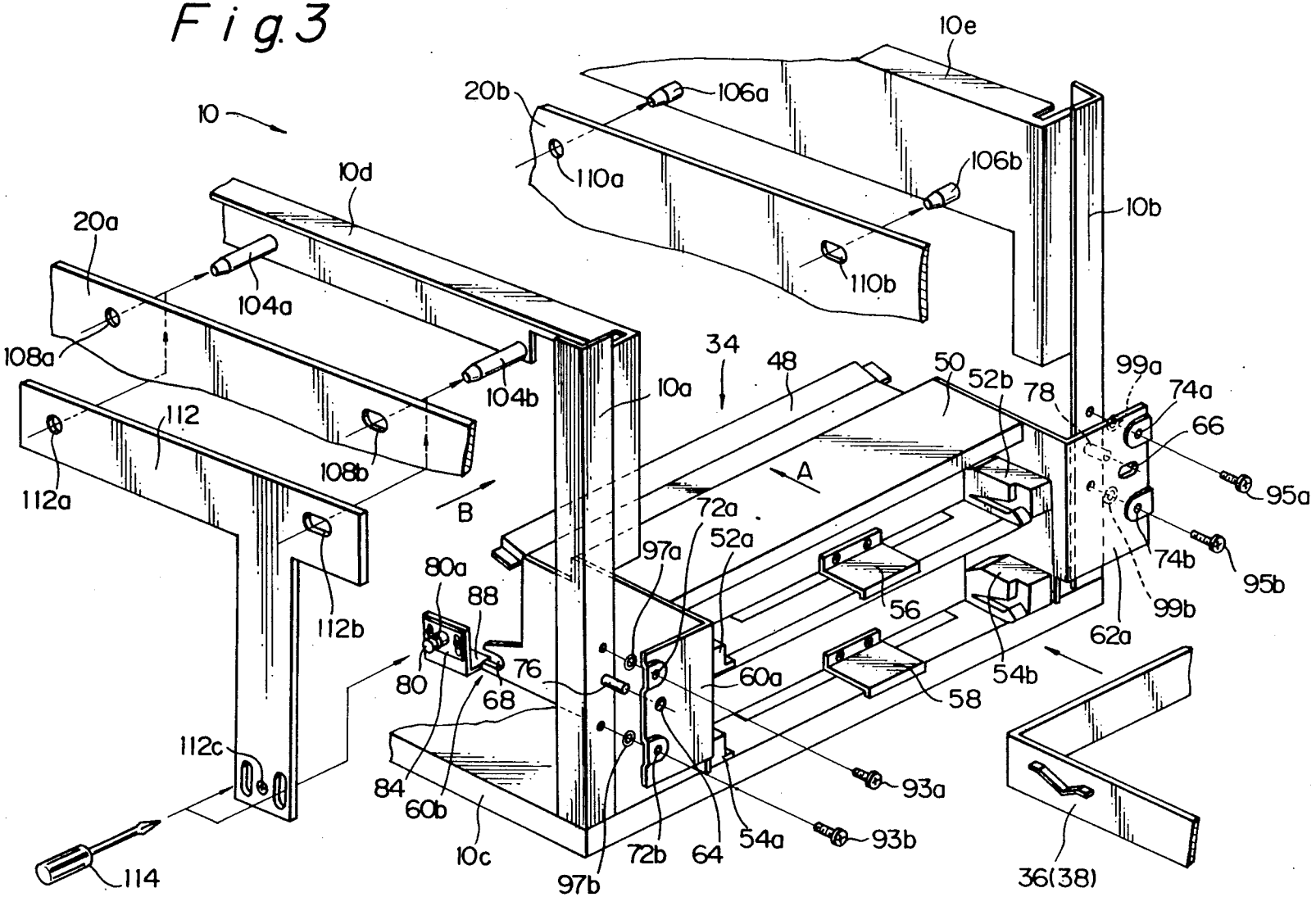
FIG. 3 is a perspective view demonstrating a procedure for mounting the sheet feeder of FIG. 2 on the printer.
Figure 4:
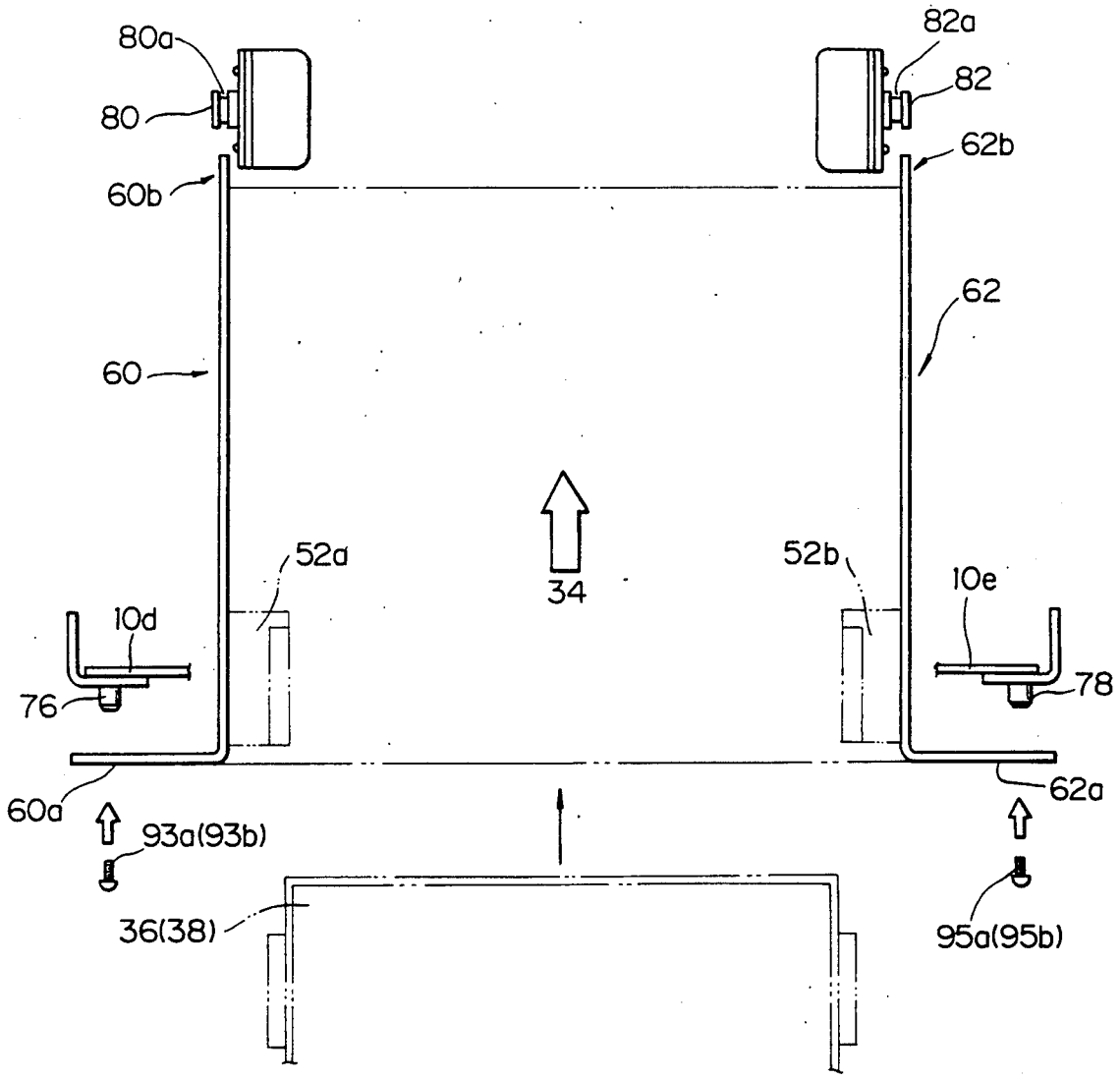
FIG. 4 is a plan view showing the sheet feeder accommodated in the printer.
Figure 5:
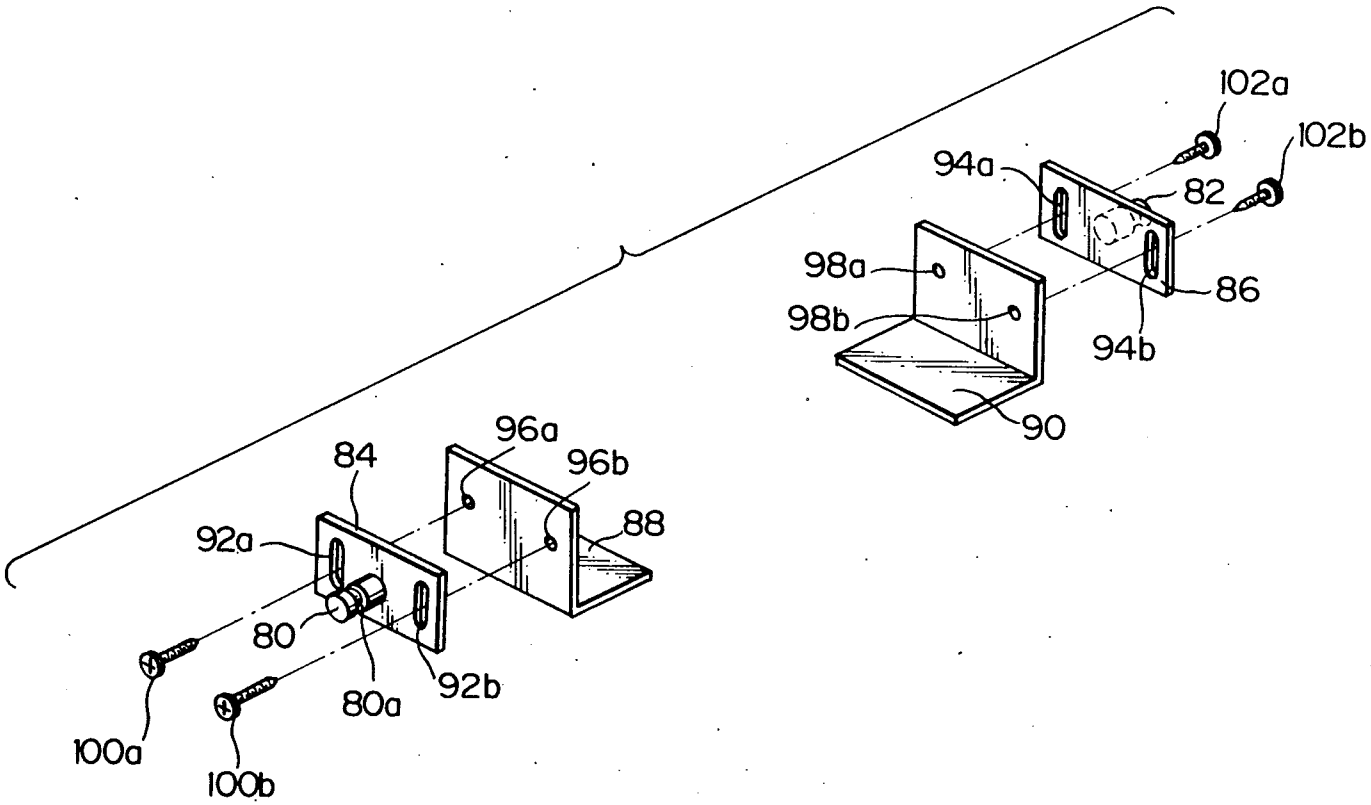
FIG. 5 is an exploded perspective view showing positioning pins and support members therefor which are affixed to a botom panel of the printer.

Referring to FIGS. 3, 4, and 5, positioning pins 76 and 78 are respectively studded on the posts 10*a* and 10*b* of the printer 10, and each mates with respective one of the holes 64 and 66 of the side plates 60 and 62 of the sheet feeder 34. Positioning pins 80 and 82 extend sideways from a bottom panel 10*c* of the printer 10 to mate respectively with the notches 68 and 70 of the projections 60*b* and 62*b* of the side plates 60 and 62. Specifically, as shown in FIG. 5, the positioning pins 80 and 82 are individually mounted on the bottom panel 10*c* by brackets 84 and 86 and bracket support plates 88 and 90. The positioning pins 76, 78, 80 and 82 maintain the sheet feeder 34 in a predetermined position relative to the printer 10 when the former is loaded in the latter. As shown in FIG. 5, each of the positioning pins 80 and 82 has a circumferential groove 80*a* and 82*a*, respectively. These pins 80 and 82 are fixed to their associated brackets 84 and 86 by welding or similar technology. The brackets 84 and 86, are formed with slots 92*a* and 92*b* and 94*a* and 94*b*, respectively. Each being configured in the form of a letter L, the brackets 84 and 86 are fixed to the bottom panel 10*c* of the printer 10, FIG. 3, and are provided with threaded holes 96*a* and 96*b* and 98*a* and 98*b*, respectively. Screws 100*a* and 100*b* and 102*a* and 102*b* are respectively passed through the slots 92*a* and 92*b* and 94*a* and 94*b* of the brackets 92 and 94 and the threaded holes 96*a* and 96*b* and 98*a* and 98*b* of the bracket support plates 88 and 90. The brackets 84 and 86 are, therefore, securely connected to their associated bracket support plates 88 and 90 and, yet, adjustable up and down as needed. As shown in FIG. 3, the side plates 60 and 62 of the sheet feeder 34 are respectively fastened to the posts 10*a* and 10*b* of the printer 10 by screws 93*a* and 93*b* and 95*a* and 95*b* and washers 97*a* and 97*b* and 99*a* and 99*b*, the screws 93*a* and 93*b* and 95*a* and 95*b* being respectively passed through the openings 72*a* and 72*b* and 74*a* and 84*b*.

The sheet feeder 34 having the above construction is inserted in the printer 10 in a direction indicated by an arrow A in FIG. 3, while the developing device 20 is inserted in the same in a direction indicated by an arrow B which is perpendicular to the direction A. Hence, the sheet feeder 34 and the developing device 20 have to be positioned accurately relative to each other within the printer housing 12. To meet this requirement, positioning pins 104*a* and 104*b* and 106*a* and 106*b* are respectively studded on a front and a rear panel 10*d* and 10*e* of the printer 10 for the purpose of positioning the developing device 20. The developing device 20 has a front and a rear plate 20*a* and 20*b* which are formed with holes 108*a* and 108*b* and 110*a* and 110*b*, respectively. The positioning pins 104*a* and 104*b* and 106*a* and 106*b* mate with the holes 108*a* and 108*b* and 110*a* and 110*b*, respectively. The front and rear panels 10*d* and 10*e* of the printer 10 are fixed to and accurately positioned relative to the posts 10*a* and 10*b*, respectively.

To position the sheet feeder 34 relative to the printer 10, the notches 68 and 70 of the projections 60*b* and 62*b* which extend out from the side plates 60 and 62 are respectively engaged with the circumferntial grooves 80*a* and 82*a* of the positioning pins 80 and 82. More specifically, as shown in FIG. 3, use is made of a generally T-shaped jig 112 having upper jig holes 112*a* and 112*b* and a lower jig hole 112*c*. The upper jig holes 112*a* and 112*b* are mated with the positioning pins 104*a* and 104*b* which are studded on the printer side panel 10*d*, while the lower jig hole 112*c* is mated with the positioning pin 80 affixed to the printer bottom panel 10*c*. Thereupon, the screws 100*a* and 100*b*, FIG. 5, are respectively driven into the threaded holes 96*a* and 96*b* through the associated slots 92*a* and 92*b* of the brackets 84.

Figure 6A:
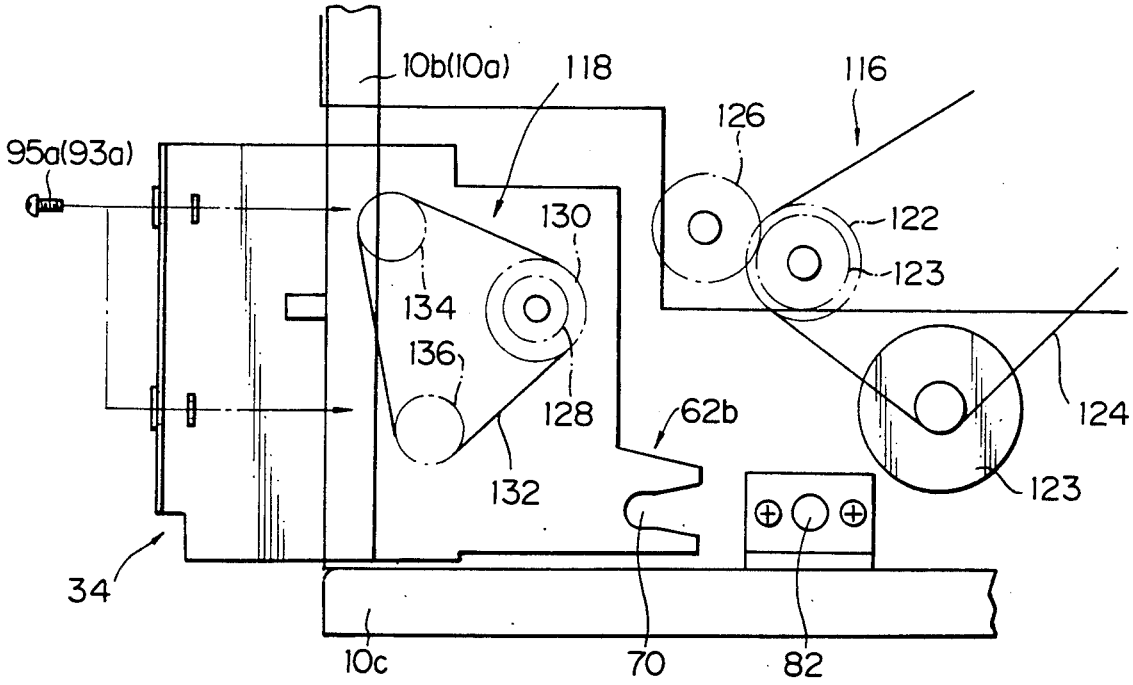
FIG. 6A is a side elevation showing an arrangement for driving the sheet feeder.
Figure 6B:
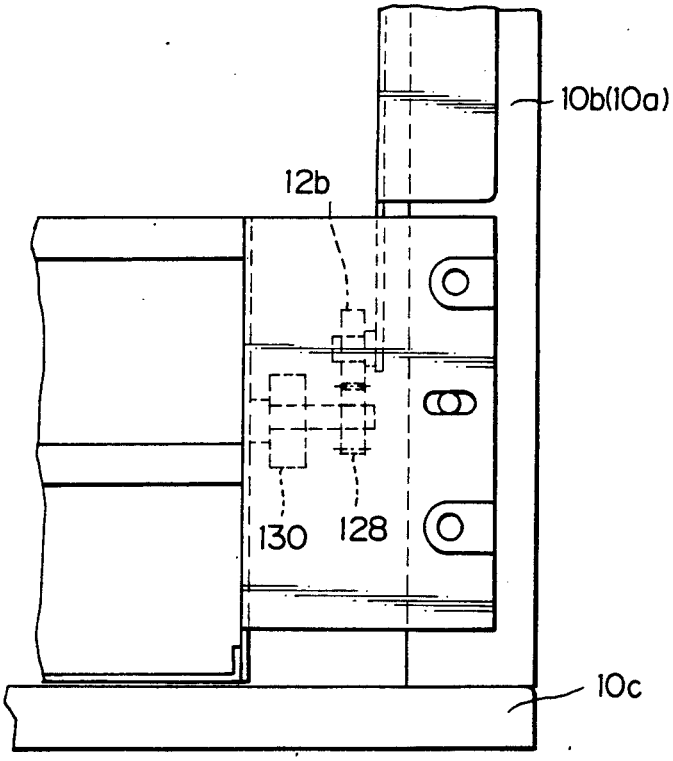
FIG. 6B is a plan view of the arrangement shown in FIG. 6A.

Referring to FIGS. 6A and 6B, an arrangement for driving the sheet feeder 34 which is mounted on the printer 10 is shown. As shown, the arrangement is made up of two coactive drive mechanisms 116 and 118 which are loaded in the printer 10 and the sheet feeder 34, respectively. The drive mechanism 116 has a motor 120, a pulley 122, a belt 124 for transmitting the rotation of the motor 120 to the pulley 122, a gear 123 rotatable integrally with the pulley 122, and a gear 126 held in mesh with the gear 123. The other drive mechanism 118 has a gear 128 meshable with the gear 126 to be rotated by the motor 120, a pulley 130 rotatable integrally with the gear 128, and a belt 132 passed over the pulley 130 and pulleys 134 and 136. A mechanisms for transmitting the rotation to the pull-out rollers 40 and 42 and feed roller pairs 44 and 46 is associated with the pulleys 134 and 136. In this configuration, the pull-out rollers 40 and 42 and feed roller pairs 44 and 46 are driven by the motor 120 via the belt 124, pulley 122, gear 123, gear 126, gear 128, pulley 130 and belt 132 to feed paper sheets out of their associated sheet cassettes 36 and 38 toward the register roller pair 32.

In summary, it will be seen that the present invention provides a sheet feeder which can be positioned easily and, yet, accurately relative to an image forming apparatus when loaded in the latter. The sheet feeder of the present invention has holes formed through bent portions of a pair of side plates thereof which form a part of a housing, and notches formed in projections thereof. The holes are individually mated with positioning pins which are studded on two posts of the image forming apparatus, while the notches are individually mated with positioning pins which are affixed to a bottom panel of the apparatus.

Various modifications will become possible for those skilled in the art after receiving the teachings of the present disclosure without departing from the scope thereof.

What is claimed is:

1. A sheet feeder for an image forming apparatus for feeding paper sheets from a sheet cassette which is removably loaded in said sheet feeder, comprising:

cassette supporting means comprising a guide member for guiding the sheet cassette when said sheet cassette is mounted, and a pusher member for raising a bottom plate of said sheet cassette;

sheet guiding means for guiding the paper sheet fed from the sheet cassette;

a pair of side plate members attached to the cassette supporting means, each having a bent portion to be fastened to a post of the image forming apparatus and a projection to be engaged with a bottom panel of said image forming apparatus;

a hole formed through said bent portion for mating with a first positioning pin which is studded on the post; and a notch formed in said projection for mating with a second positioning pin which is affixed to the bottom panel.

2. A sheet feeder as claimed in claim 1, wherein said second positioning pin is adjustable in position up and down relative to the bottom panel.

3. A sheet feeder as claimed in claim 2, wherein said second positioning pin is fixed to a bracket having a vertically extending slot, said bracket being fastened to a support plate which is fixed to the bottom panel with a screw being passed through said slot.

4. A sheet feeder as claimed in claim 3, wherein said second positioning pin has a circumferential groove which is engageable with said notch of said side plate member.

* * * * *